US005913306A

United States Patent [19]

Moroi et al.

[11] Patent Number: 5,913,306

[45] Date of Patent: Jun. 22, 1999

[54] VISCOUS FLUID HEATER

[75] Inventors: Takahiro Moroi; Takashi Ban; Tatsuya Hirose; Kazuhiko Minami, all of Kariya, Japan

[73] Assignee: Kabushiki Kaisha Toyoda Jidoshokki Seisakusho, Japan

[21] Appl. No.: 09/060,493

[22] Filed: Apr. 15, 1998

[30] Foreign Application Priority Data

Apr. 21, 1997 [JP] Japan ..... 9-103395

[51] Int. Cl.[6] ..... F22B 3/06

[52] U.S. Cl. ..... 126/247; 237/12.3 R; 123/142.5 R; 122/26

[58] Field of Search ..... 237/12.3 R, 12.3 B; 122/26; 126/247; 123/142.5 R

[56] References Cited

U.S. PATENT DOCUMENTS 4,993,377 2/1991 Itakura ..... 123/142.1 R 5,573,184 11/1996 Martin ..... 237/12.3 R

*Primary Examiner*—Henry Bennett

*Assistant Examiner*—Derek Boles

*Attorney, Agent, or Firm*—Woodcock Washburn Kurtz Mackiewicz & Norris LLP

[57] ABSTRACT

A viscous fluid type heater including a stator having a stationary surface and a rotor having a rotary surface. The rotary surface is opposed to the stationary surface to define a clearance therebetween for the accommodation of a viscous fluid. A circulating fluid flows through a heat exchanging chamber. The rotor rotates about its axis and shears the viscous fluid to produce heat. The heat is transmitted to the circulating fluid from the viscous fluid. The rotary surface is inclined with respect to the rotor axis. The stationary surface is inclined in conformity with the rotary surface.

21 Claims, 5 Drawing Sheets

VISCOUS FLUID HEATER

BACKGROUND OF THE INVENTION

The present invention relates to vehicle heaters that shear viscous fluid to generate heat and transmit the heat to a coolant fluid. More particularly, the present invention relates to a viscous fluid heater employing a rotor having an inclined shearing surface.

Viscous fluid heaters are used as an auxiliary heat source for automobiles and are driven by the force of the engine. Japanese Unexamined Patent Publication No. 2-246823 describes a typical viscous fluid heater, which is incorporated in an automobile heater.

The viscous heater has a front housing element and a rear housing element that are coupled to each other to form a housing. A heating chamber and a water jacket (heat exchange chamber), which encompasses the heating chamber, are defined in the housing. A drive shaft extends through the front housing element and is rotatably supported by a bearing. A rotor is fixed to one end of the drive shaft in the heating chamber so that the rotor and the drive shaft rotate integrally with each other. Walls project axially from the front and rear surfaces of the rotor. Grooves are defined in the heating chamber walls to receive the rotor walls. A clearance is provided between the rotor walls and the heating chamber grooves. The clearance contains a predetermined amount of viscous fluid such as silicone oil.

When engine power is transmitted to the drive shaft, the rotor is rotated integrally with the drive shaft in the heating chamber. This shears the viscous fluid located between the rotor surface and the heating chamber walls. The shearing effect causes fluid friction that generates heat. The heated silicone oil exchanges heat with engine coolant, which circulates through the water jacket. The heated coolant is then sent to an external heater circuit and used to warm the passenger compartment.

In the prior art heater, the viscous fluid is constantly sheared by the rotor. Furthermore, the rotating velocity of the rotor (shearing velocity) is higher at positions located farther from the axis of the rotor. Thus, the shearing velocity is higher at the periphery of the rotor. This may result in local overheating of the viscous fluid located near the periphery. Such overheating leads to early deterioration of the viscous fluid.

SUMMARY OF THE INVENTION

Accordingly, it is an objective of the present invention to provide a viscous fluid heater that permits movement of the viscous fluid in the heating chamber to prevent or delay local thermal deterioration of the viscous fluid and thus maintain a superior heating capability.

To achieve the above objective, the present invention provides an improved viscous fluid type heater. The heater includes a stator having a stationary surface and a rotor having a rotary surface. The rotary surface is opposed to the stationary surface to define a clearance therebetween for the accommodation of a viscous fluid. The rotor rotates about its axis and shears the viscous fluid to produce heat. The heater further includes a heat exchanging chamber through which a circulating fluid flows. The heat is transmitted to the circulating fluid from the viscous fluid. The rotary surface is inclined with respect to the rotor axis, and the stationary surface is inclined in conformity with the rotary surface.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a viscous fluid heater according to the present invention will now be described with reference to FIGS. 1 to 3.

Figure 1:
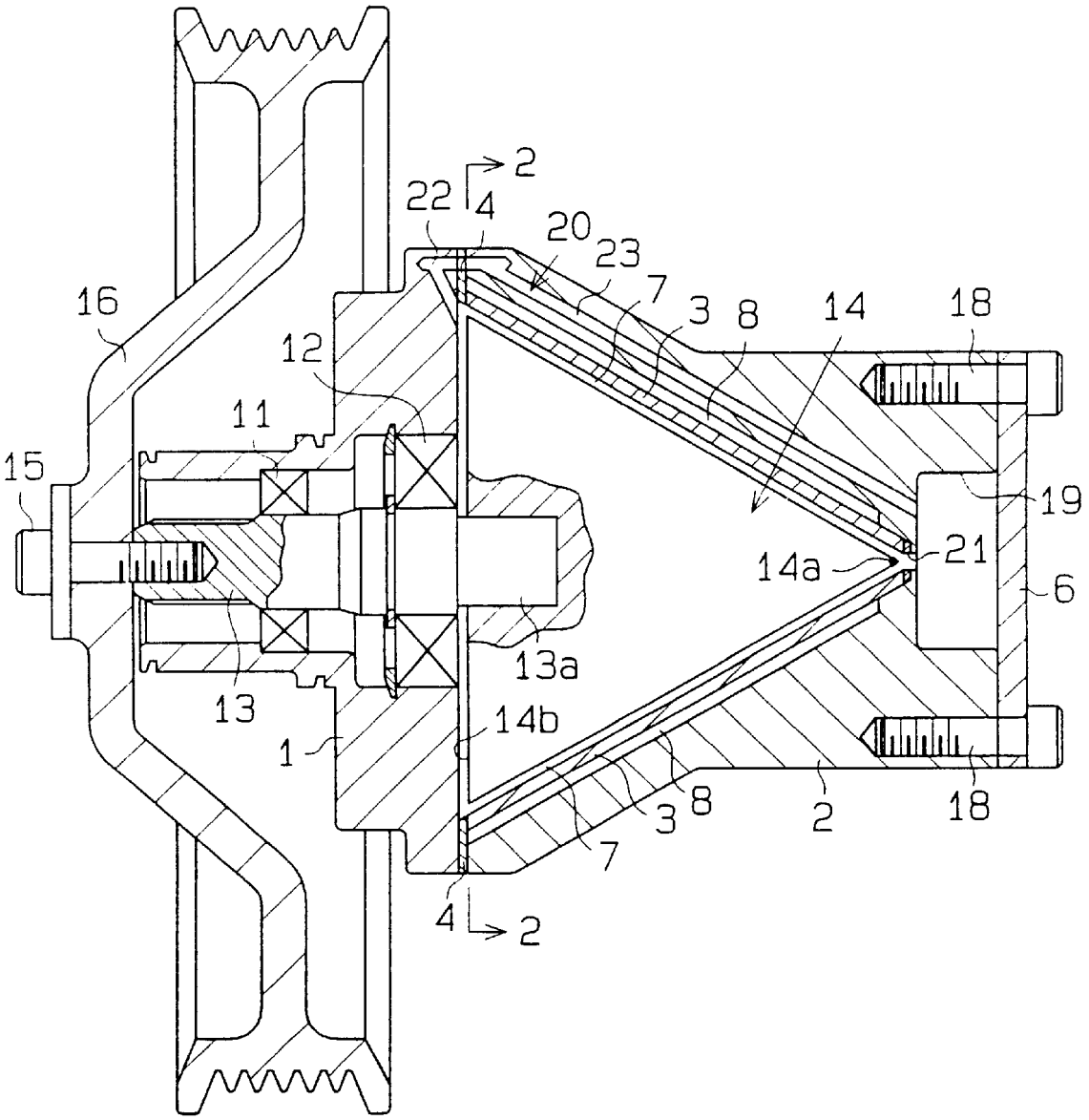
FIG. 1 is a cross-sectional view showing a viscous fluid heater according to the present invention.

As shown in FIG. 1, the viscous fluid heater has a front housing element 1, a rear housing element 2, and a stator element 3, which is located in the rear housing element 2. The stator element 3 is hollow and has a conical inner surface (stationary surface) and a conical outer surface. The rear housing element 2 has a conical interior to accommodate the stator element 3. The rear housing element 2 and the front housing element 1 are fastened to each other by a plurality of bolts 5 (FIG. 2) with a gasket 4 arranged in between. A rear plate 6 is fastened to the rear end of the rear housing element 2 by a plurality of bolts 18 to define a reservoir chamber 19 in the rear housing element 2. The front housing element 1, the rear housing element 2, the stator element 3, and the rear plate 6 form a housing, which serves as a stator.

A heating chamber 7 is defined between the rear end of the front housing element 1, and the inner surface of the stator element 3. A water jacket 8, which serves as a heat exchange chamber, is defined between the outer surface of the stator element 3 and the inner surface of the rear housing element 2. Thus, the stator element 3 is encompassed by the water jacket 8.

Figure 2:
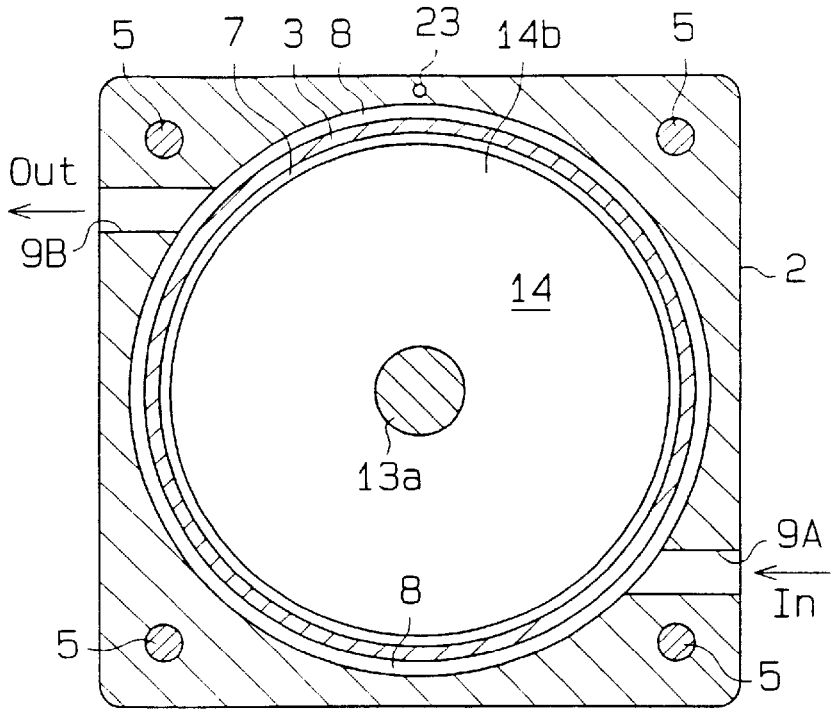
FIG. 2 is a cross-sectional view showing the viscous fluid of FIG. 1 taken along line 2—2 of FIG. 1.

As shown in FIG. 2, the water jacket 8 has an annular cross-section. An inlet port 9A extends through the lower right portion of the rear housing element 2, while an outlet port 9B extends through the upper left portion of the rear housing 2, as viewed in FIG. 2. Fluid (e.g., engine coolant)

circulates between the water jacket 8 and a heater circuit (not shown). More specifically, the fluid in the heater circuit is drawn into the water jacket 8 through the inlet port 9A and returned to the heater circuit through the outlet port 9B. The inlet port 9A is located below the outlet port 9B so that the fluid circulates from the lower portion of the stator element 3 to the upper portion of the stator element 3 before being discharged through the outlet port 9B.

As shown in FIG. 1, a drive shaft 13 is rotatably supported by a front bearing 11 and a rear bearing 12, which are housed in the front housing 1. The rear bearing 12 includes a seal to seal the front side of the heating chamber 7. The rear end 13*a* of the drive shaft 13 extends into the heating chamber 7. A rotor 14, which serves as a shearing device, is fitted to the rear end 13*a* of the drive shaft 13. A pulley 16 is fixed to the front end of the drive shaft 13 by bolts 15. The drive shaft 13 is connected to external drive source such as an engine (not shown) by a power transmitting belt (not shown) fitted around the pulley 16.

The conical rotor 14 has a vertex 14*a*, a base 14*b*, and a conical surface (rotary surface). The vertex 14*a* is located on the drive shaft rotation axis C. The base 14*b* is opposite to the vertex 14*a*. The conical surface is defined by lines connecting the vertex 14*a* to the periphery of the base 14*b*. Therefore, the diameter of the rotor 14 is larger at positions closer to the base 14*b*.

The base 14*b* of the conical rotor 14 and the rear end surface of the front housing 1 face each other with a predetermined first distance, or clearance, provided between them. Each line that passes through the base periphery and the vertex 14*b* is inclined with respect to the rotary axis C by an angle corresponding to half of the angle forming the vertex, or angle $\theta_H$ (FIG. 3). The conical surface of the rotor 14 and the inner surface (also conical) of the stator element 3 face each other with a predetermined second distance h, or second clearance between them. Thus, the conical surface of the rotor 14 is inclined with respect to the rotation axis C and is spaced from the inner surface of the stator element 3. The rotor's conical surface functions as a shearing surface. The first distance and the second distance h may be same or different.

A supply passage 21 extends through a central portion of the rear housing 2, and a vertex region of the stator element 3. The reservoir chamber 19 and the heating chamber 7 communicate with each other through the supply passage 21. Therefore, the vertex region and the reservoir chamber 19 are close to each other and communicate with each other through the supply passage 21.

As shown in FIGS. 1 and 2, a front-side passage 22 extends through the front housing element 1, while a rear-side passage 23 extends through the rear housing element 2. As shown in FIG. 1, the front-side passage 22 is bent in the front housing element 1. A lower opening of the front-side passage 22 is located near the outer boundary of the front side of the heating chamber 7. The rear-side passage 23 in the rear housing element 2 inclines along the water jacket 8. A rear-side opening of the rear-side passage 23 is located in the reservoir chamber 19, while the front-side opening of the rear-side passage 23 is connected with the front-side passage 22 at the gasket 4.

A large-diameter part (first part) of the heating chamber 7 is located at a distance M (FIG. 3) from the vertex 14*a*. M is equal to the total axial length of the rotor 14. A small diameter part (second part) of the heating chamber 7 is located near the vertex 14*a*. The first part and the second part communicate with each other through a recovery passage 20, which includes the front-side passage 22, the rear-side passage 23, the reservoir chamber 19, and the supply passage 21.

The heating chamber 7 and the recovery passage 20 define a sealed space, which forms a loop, in the heater housing. The sealed space contains a predetermined amount of silicone oil, which serves as viscous fluid. The amount of silicone oil (Vf) is set to occupy 50% to 90% of the free space volume Vc in the sealed space. The free space volume is calculated by subtracting volumes occupied by the drive shaft 13 and the rotor 14 in the heating chamber 7 from the calculated inner space volume of the heating chamber 7 and the recovery passage 20. The minimum amount of silicone oil is set to occupy 50% of the free space volume Vc so that heat generation by shearing of the viscous fluid will be effective. The maximum amount of silicone oil is set to occupy 90% of the free space volume Vc, taking thermal expansion at an elevated temperature of the viscous fluid into consideration. Silicone oil is filled in the clearances between the rotor 14 and the inner surfaces of the heating chamber 7 and the reservoir chamber 19.

The operation of the viscous fluid heater will now be described. When the engine power (external drive source) is transmitted to the pulley 16 by the power transmitting belt, the drive shaft 13, the conical rotor 14, and the pulley 16 are rotated integrally with each other. Silicone oil in the heating chamber 7, mainly in the clearance between the inner stator surface of the heating chamber 7, which is stationary, and the conical outer surface of the rotor 14, which moves, is sheared and generates heat. The shearing is based on the relative velocity between the stationary and the moving surfaces. The generated heat is exchanged with coolant fluid circulating through the water jacket 8 by way of the stator element 3. The coolant fluid, which is heated, is sent to the heater circuit for warming the passenger compartment.

When the rotor 14 rotates, silicone oil located in the clearance between the inner wall of the heating chamber 7 and the conical surface of the rotor 14 moves helically from the vertex 14*a* to the periphery of the base 14*b* along the conical surface of the rotor 14. Silicone oil tends to move radially by centrifugal force generated by the rotation of the rotor 14. However, radially moving oil is directed toward the front end, or large-diameter end, of the rotor 14 by the inclined inner wall of the heating chamber 7. Therefore, when the rotor 14 rotates, one vector, which directs silicone oil in a circular direction, and another vector, which directs the oil toward the front side (base 14*b*) of the rotor 14, both act on the silicone oil in the clearance. Thus, the silicone oil moves helically in the clearance between the inner wall of the heating chamber 7, and the conical surface of the rotor 14.

As a result, as the speed of the rotor 14 increases, the oil pressure in the clearance near the base 14*b* of the rotor 14 becomes higher than the oil pressure in the clearance near the vertex 14*a*. This causes silicone oil to be urged to the front-side passage 22. The silicone oil is then transferred to the reservoir chamber 19 by way of the rear-side passage 23. Silicone oil recovered in the reservoir chamber 19 from the heating chamber 7 stays in the reservoir chamber 19 for a certain cycle time. Silicone oil stored in the reservoir chamber 19, which is not sheared or exposed to heat for a long period of time, is protected from thermal deterioration.

When the fluid level of the silicone oil in the reservoir chamber 19 becomes higher, the pressure that urges oil into the heating chamber 7 by way of the supply passage 21 becomes stronger. Thus, silicone oil is smoothly and quickly supplied to the vicinity of the vertex 14*a* by way of the supply passage 21. The silicone oil supplied to the heating chamber 7 quickly fills the clearance formed between the inner wall of the heating chamber 7 and the outer surface of the rotor 14 by the helical movement.

The heating capability of the viscous heater will now be described. As shown in FIG. 3, if a distance extending axially from the vertex 14*a* of the rotor 14 is arbitrarily set as m, a radius of the rotor 14 located at a distance m from the vertex 14*a* is set as r, the total length of the rotor 14 is set as M, the radius of the base 14*b* of the rotor 14 is set as R, and the half of a vertex angle of the cross-section of the rotor 14 is set as $\theta_H$, then $\tan\theta_H$, and an infinitesimal change dm are shown in the following formulas 1:

$$\tan\theta_H = \frac{r}{m} = \frac{R}{M}$$

$$\therefore dm = \frac{M}{R} dr$$

While, if a viscosity coefficient of the silicone oil (viscous fluid) is set as $\mu$, a rotational angular velocity of the rotor 14 is set as $\omega$, a peripheral velocity at an arbitrary distance m is set as $r\omega$, and the clearance between the outer surface of the rotor 14 and the inner surface of the stator element 3 (inner wall of the heating chamber 7) is set as h, then shearing stress $\tau$ is shown in the following formula 2:

Shearing Stress $$\tau = \mu\left(\frac{r\omega}{h}\right)$$

$\mu$: viscosity coefficient of viscous fluid $r\omega$: peripheral velocity at an arbitrary distance m $r\omega/h$: velocity gradient Based on the formulas 1 and 2, the total torque T of the rotor 14 is shown in the following formula 3:

Total Torque $$T = \int_0^M r \cdot \tau \cdot 2\pi r \cdot dm = \int_0^R r \cdot \mu\left(\frac{r\omega}{h}\right) \cdot 2\pi r \cdot \frac{M}{R} dr = \frac{2\pi\mu\omega M}{h \cdot R} \int_0^R r^3 dr = \frac{2\pi\mu\omega M}{h \cdot R} \times \frac{R^4}{4} = \frac{\pi}{2h}\mu\omega M R^3$$

Therefore, since the heat quantity Q of the viscous heater is proportional to the drive power of the rotor 14 ($L=T\omega$), the relationship between the heat quantity Q and various parameters is shown in the following formula 4:

Heat Quantity $$Q \propto \text{Power } L = T\omega = \frac{\pi}{2h}\mu\omega^2 M R^3$$

As seen from formula 4, the heat quantity Q is proportional to the third power of the radius R, and is also proportional to the total length M of the rotor 14. When a larger heat quantity Q is required, it is possible to increase the total length M without changing the radius R. Since an increase of the radius is not essential when the heat quantity Q is increased, a wide latitude in determining the dimensions of the rotor 14 is allowed when designing the heater.

The preferred and illustrated embodiment has the advantages described below.

The rotor 14 is conical. The radius increases at positions closer to the base 14*b*. Silicone oil is located in the clearance between the conical outer surface of the rotor 14 and the inner surface of the heating chamber 7. When the rotor 14 rotates, the silicone oil moves from the vertex 14*a* of the rotor 14 to the periphery of the base 14*b* of the rotor 14 in a helical path. This prevents localized overheating of the silicone oil. Thus, the silicone oil is protected from over-exposure to heat. As a result, thermal deterioration is prevented and superior heating is maintained.

When the rotor 14 rotates, silicone oil starts to move in the heating chamber 7. This causes an oil pressure difference, or causes a pressure gradient along the axial direction in the clearance. The oil pressure becomes higher at positions closer to the periphery of the base 14*b*. This causes silicone oil to be urged into the recovery passage 20, which is opened at a location near the front peripheral region of the heating chamber 7, and to advance to the rear end region of the heating chamber 7 by way of the recovery passage 20. Therefore, the silicone oil is smoothly circulated between the heating chamber 7 and the recovery passage 20. The circulation of oil prevents thermal deterioration of the oil caused by local over-shearing of the oil.

Since silicone oil is supplied to the reservoir 19, a sufficient amount of oil for shearing is guaranteed. When the rotor 14 rotates, silicone oil circulates between the heating chamber 7 and the reservoir 19 by way of the recovery passage 20. This prevents local over-shearing of oil and allows the oil stored in the reservoir 19 to rest from shearing. Thus, thermal deterioration of the oil is prevented.

As seen from the calculation of the heat quantity Q, the total heat quantity Q is increased by increasing the total length M of the rotor 14, instead of enlarging the radius R of the base 14*b*. Therefore, the heat quantity Q is determined by controlling the base radius R and the total length M of the rotor 14. Thus, a wide latitude in designing the shape of the viscous fluid heater is allowed.

Optionally, the preferred embodiment may be modified or operated as described below.

Figure 4:
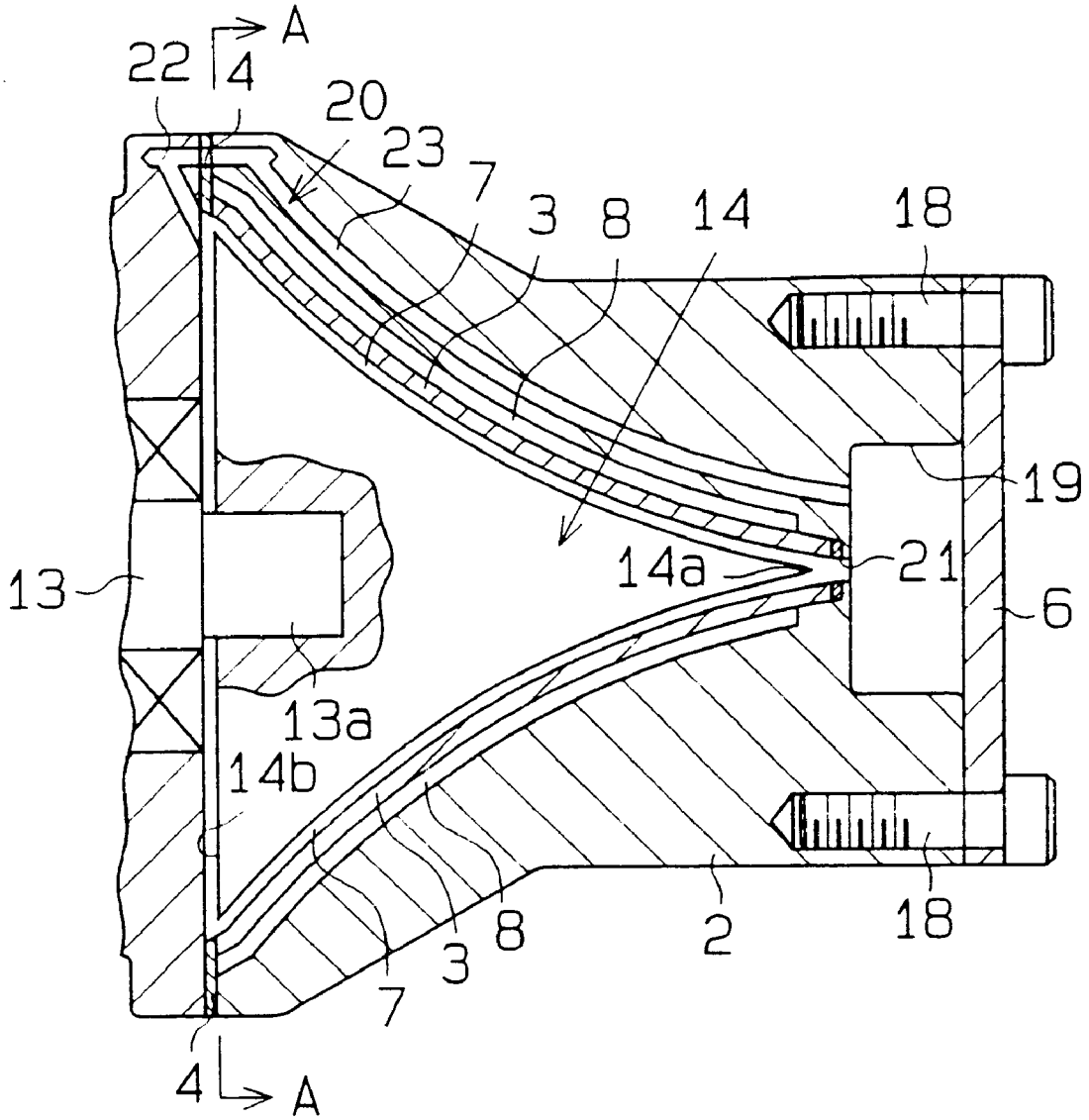
FIG. 4 is a cross-sectional view showing a conical rotor employed in a further embodiment of a viscous fluid heater according to the present invention.
Figure 5:
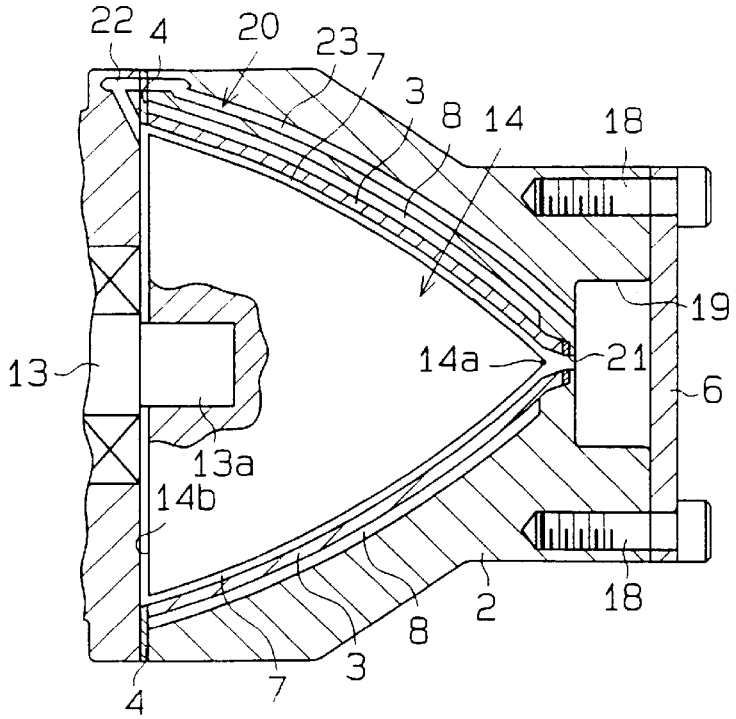
FIG. 5 is a cross-sectional view showing a conical rotor employed in a further embodiment of a viscous fluid heater according to the present invention.
Figure 6:
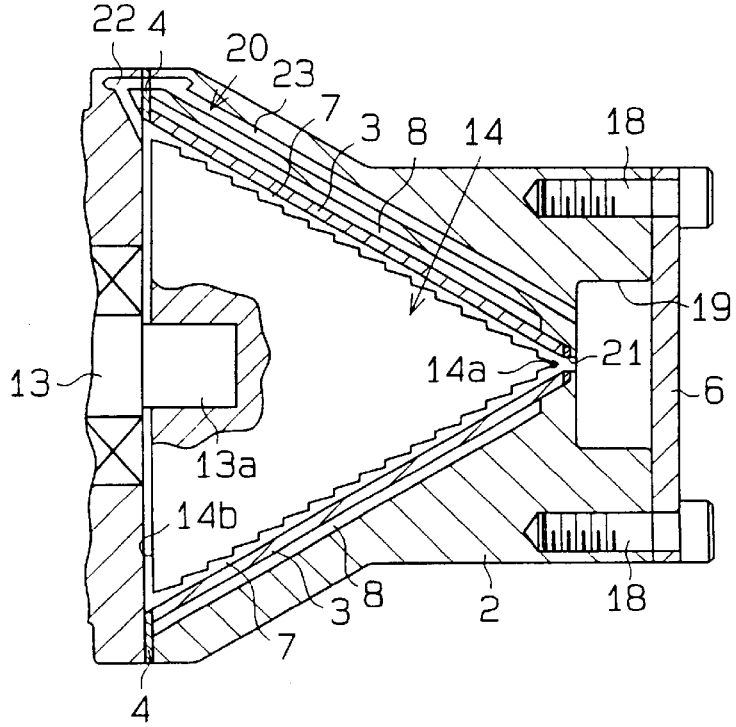
FIG. 6 is a cross-sectional view showing a conical rotor employed in a further embodiment of a viscous fluid heater according to the present invention.

As shown in FIG. 4, the rotor 14 may have a quadratic curve that bends toward the axis. As shown in FIG. 5, the rotor 14 may have a quadratic curve that bends away from the axis. The rotor 14 in the preferred embodiment is a cone, which is defined by lines connecting the vertex 14*a* to the periphery of the base 14*b* (a circle). As shown in FIG. 6, the rotor 14 may have a conical surface with steps. In all structures described above, silicone oil smoothly moves in the clearance toward the periphery of the base 14*b*. Each rotor 14 in FIGS. 4 to 6 has a radius that gradually increases toward the rotor base 14*b*.

Figure 3:
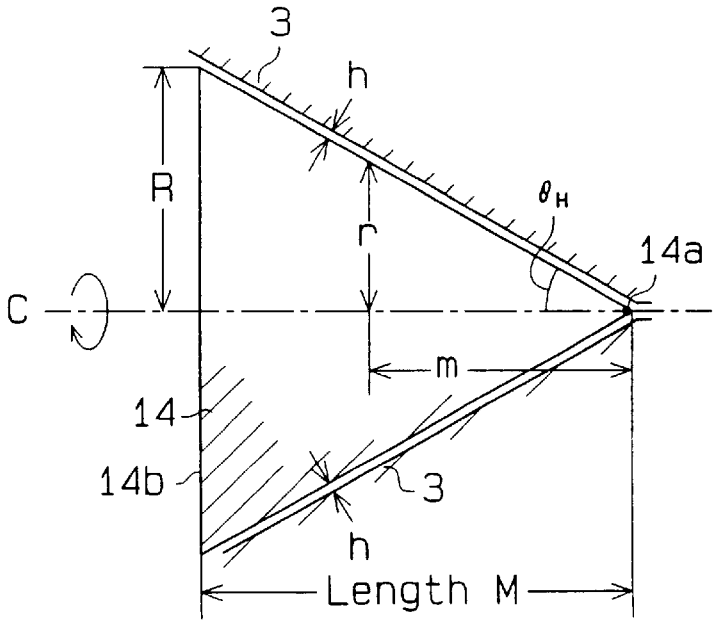
FIG. 3 is a diagrammatic view illustrating the dimensions of the conical rotor shown in FIG. 1.

In the preferred embodiment shown in FIGS. 1 to 3, a reservoir chamber 19 is provided at a position in the recovery passage 20. It is possible to remove the reservoir chamber 19. Even in such a structure, silicone oil is satisfactorily circulated between the heating chamber 7 and the recovery passage 20. Thus, the thermal deterioration of the silicone oil caused by overheating is delayed.

In the preferred embodiment shown in FIGS. 1 to 3, the vertex and the base regions of the rotor 14 are connected by a circulating passage (recovery passage 20). It is possible to arrange the circulating passage to connect any two points located between the vertex and the base regions. In such a structure, silicone oil is satisfactorily circulated and the thermal deterioration of silicone oil caused by overheating is delayed. However, it is necessary that the radius of the rotor 14 at the outlet of the recovery passage 20 be smaller than the radius of the rotor 14 at the inlet of the recovery passage 20.

Figure 7:
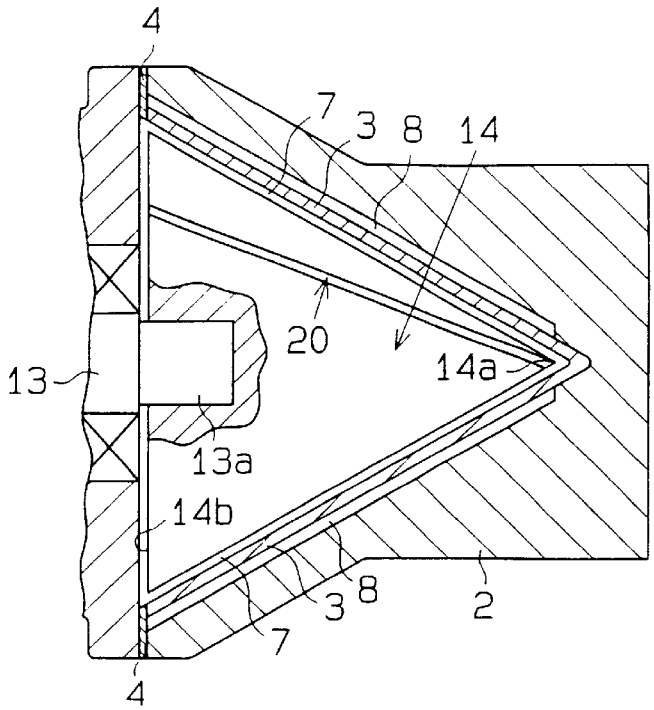
FIG. 7 is a cross-sectional view showing a recovery passage employed in a further embodiment of a viscous fluid heater according to the present invention.

In the preferred embodiment shown in FIGS. 1 to 3, the recovery passage 20 is arranged in the heater housing. As shown in FIG. 7, the recovery passage 20 may be arranged inside the rotor 14. In such a structure, heated silicone oil moves inside the rotor 14 from the front end to the rear end and decreases a temperature difference between any two points selected axially. (The temperature tends to be higher at positions closer to the front end.) This will decrease the temperature difference of the silicone oil in the clearance and delay the deterioration caused by overheating a part of the silicone oil.

Figure 8:
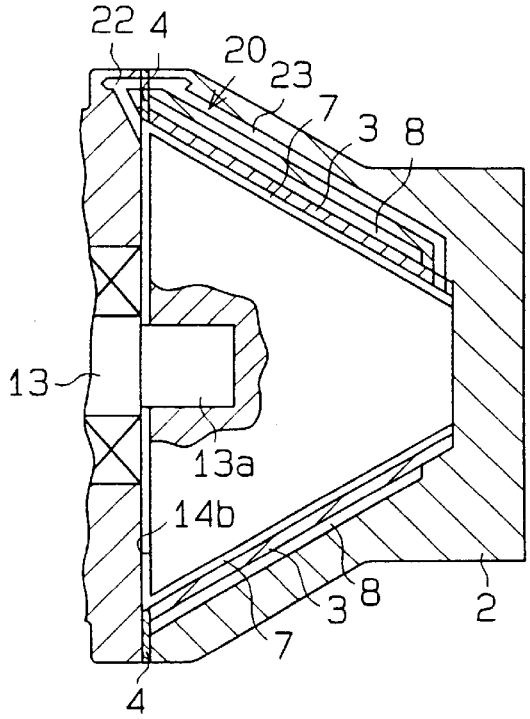
FIG. 8 is a cross-sectional view showing a conical rotor employed in a further embodiment of a viscous fluid heater according to the present invention.

As shown in FIG. 8, the rotor 14 may be shaped like a truncated cone without the vertex 14*a*. In such a structure, it is possible for the silicone oil to move helically in the clearance and to be circulated by way of the recovery passage 20. It is necessary that the outlet of the recovery passage 20 be located facing the conical surface of the rotor 14, preferably near the smallest-diameter portion of the rotor 14.

In the viscous heater shown in FIGS. 1 to 3, an electromagnetic clutch may be provided between the pulley 16 and the drive shaft 13. In such a structure, the drive force is selectively transmitted to the drive shaft 13. This will stop transmitting the drive force at any required time and control the shearing action of the silicone oil in the heating chamber 7. Thus, the thermal and mechanical deterioration of silicone oil caused by overshearing will be delayed.

The term "viscous fluid" refers to any type of medium that generates heat based on fluid friction when sheared by a rotor. The term is therefore not limited to viscous fluid or semi-fluid having high viscosity, much less to silicone oil.

It should be apparent to those skilled in the art that the present invention may be embodied in may other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A viscous fluid type heater comprising:

a stator having a stationary surface;

a rotor having a rotary surface, the rotary surface opposing the stationary surface to define a clearance therebetween for the accommodation of a viscous fluid, wherein the rotor rotates about its axis and shears the viscous fluid to produce heat; and a heat exchanging chamber through which a circulating fluid flows, wherein the heat is transmitted to the circulating fluid from the viscous fluid;

wherein the rotary surface is inclined with respect to the rotor axis, and the stationary surface is inclined in conformity with the rotary surface.

2. The heater as set forth in claim 1, wherein said stator includes a housing for housing a heating chamber, the heating chamber having a wall surface serving as the stationary surface, wherein said rotor is disposed in the heating chamber, the rotor having an outer surface serving as the rotary surface and opposing the heating chamber wall surface to define the clearance.

3. The heater as set forth in claim 1, wherein said rotor has a first axial end and a second axial end, and wherein said rotor has a diameter increasing from the first end to the second end.

4. The heater as set forth in claim 3, further comprising a recovery passage that allows the viscous fluid to flow away from and toward the heating chamber.

5. The heater as set forth in claim 4, wherein said recovery passage communicates with the heating chamber, and wherein a stator is provided to partition the heat exchange chamber off from the recovery passage.

6. The heater as set forth in claim 5, wherein said recovery passage extends through the rotor.

7. The heater as set forth in claim 5, further comprising a reservoir chamber communicating with the heating chamber and the recovery passage to supplementally accommodate viscous fluid, wherein said reservoir chamber forms a part of the recovery passage.

8. The heater as set forth in claim 7, wherein said outer surface of the rotor is concave.

9. The heater as set forth in claim 7, wherein said outer surface of the rotor is convex.

10. The heater as set forth in claim 7, wherein said outer surface of the rotor includes plurality of steps.

11. The heater as set forth in claim 3, wherein said rotor has a conical shape.

12. A viscous fluid type heater comprising:

a heating chamber accommodating viscous fluid, said heating chamber having an inner wall;

a rotor disposed in the heating chamber, said rotor having an outer surface opposing the inner wall, wherein said rotor rotates about its rotating axis and shears the viscous fluid existing between the outer surface of the rotor and the inner wall of the heating chamber to produce heat;

a heat exchanging chamber allowing circulating fluid to flow therethrough, wherein the heat is transmitted to the heat exchange chamber from the heating chamber;

said inner wall of the heating chamber being inclined in conformity with the outer surface of the rotor;

said outer surface being arranged to forcibly apply centrifugal force to the viscous fluid based on a rotation of the rotor, whereby the viscous fluid is forcibly flowed in a direction; and said inner surface being arranged to receive the viscous fluid flowing in the direction according to the centrifugal force and change the direction of the viscous fluid.

13. The heater as set forth in claim 12, wherein said rotor has a first axial end and a second axial end, wherein said rotor has a diameter increasing from the first end to the second end.

14. The heater as set forth in claim 13, further comprising a recovery passage that allows the viscous fluid to flow away from and toward the heating chamber.

15. The heater as set forth in claim 14, wherein said recovery passage communicates with the heating chamber, and wherein a stator is provided to partition the heat exchange chamber off from the recovery passage.

16. The heater as set forth in claim 15, wherein said recovery passage extends through the rotor.

17. The heater as set forth in claim 16, further comprising a reservoir chamber communicating with the heating chamber and the recovery passage to supplementally accommodate viscous fluid, wherein said reservoir chamber forms a part of the recovery passage.

18. The heater as set forth in claim 17, wherein said outer surface of the rotor is concave.

19. The heater as set forth in claim 17, wherein said outer surface of the rotor is convex.

20. The heater as set forth in claim 17, wherein said outer surface of the rotor includes plurality of steps.

21. The heater as set forth in claim 13, wherein said rotor has a conical shape.

* * * * *